US011815262B2

(12) United States Patent
Rose

(10) Patent No.: US 11,815,262 B2
(45) Date of Patent: Nov. 14, 2023

(54) STEAM GENERATION APPARATUSES, PROCESSES, AND METHODS

(71) Applicant: Alan Rose, Spokane, WA (US)

(72) Inventor: Alan Rose, Spokane, WA (US)

( * ) Notice: Subject to any disclaimer, the term of this patent is extended or adjusted under 35 U.S.C. 154(b) by 0 days.

(21) Appl. No.: 17/992,800

(22) Filed: Nov. 22, 2022

(65) Prior Publication Data

US 2023/0078735 A1 Mar. 16, 2023

Related U.S. Application Data

(62) Division of application No. 16/795,274, filed on Feb. 19, 2020, now Pat. No. 11,512,847.

(60) Provisional application No. 62/807,552, filed on Feb. 19, 2019.

(51) Int. Cl.

| | |
|---|---|
| ***F22B 3/02*** | (2006.01) |
| ***F28D 20/00*** | (2006.01) |
| ***F22B 1/20*** | (2006.01) |

(52) U.S. Cl.

CPC ..... *F22B 3/02* (2013.01); *F22B 1/20* (2013.01); *F28D 20/003* (2013.01)

(58) Field of Classification Search

CPC .... F22B 1/20; F22B 3/02; F01K 3/188; F28D 20/003

See application file for complete search history.

(56) References Cited

U.S. PATENT DOCUMENTS

| | | | |
|---|---|---|---|
| 4,086,769 | A | 5/1978 | Smith |
| 4,186,794 | A | 2/1980 | Brunberg et al. |
| 4,325,217 | A | 4/1982 | Golestaneh |
| 4,636,149 | A | 1/1987 | Brown |
| 4,955,196 | A | 9/1990 | Lin et al. |
| 2011/0226447 | A1 | 9/2011 | Mieda |
| 2019/0331368 | A1 | 10/2019 | Tsuchiya et al. |
| 2022/0186635 | A1* | 6/2022 | Németh ..... F01K 23/04 |

FOREIGN PATENT DOCUMENTS

| | | |
|---|---|---|
| JP | 360138394 | 7/1985 |
| JP | 401239389 | 9/1989 |
| JP | 402093294 | 4/1990 |

OTHER PUBLICATIONS

JP 360138394 Abstract English Translation (Year: 1985).
JP 401239389 Abstract English Translation (Year: 1989).
JP 402093294 Abstract English Translation (Year: 1990).

* cited by examiner

*Primary Examiner* — Gerald L Sung

(74) *Attorney, Agent, or Firm* — Wells St. John P.S.

(57) ABSTRACT

Steam production apparatuses are provided. The apparatuses can include at least two compartments that are mechanically engaged. Processes for the production of steam are also provided. The processes can include providing liquid water to a reactive material within a first compartment to generate steam within the first compartment; transferring at least some of the steam to a second compartment that is mechanically engaged with the first compartment; and exposing the steam from the first compartment to material within the second compartment that extends when exposed to the steam, the extending of the material reducing the volume of the first compartment.

4 Claims, 5 Drawing Sheets

STEAM GENERATION APPARATUSES, PROCESSES, AND METHODS

CROSS REFERENCE TO RELATED APPLICATION

This application is a divisional of U.S. patent application Ser. No. 16/795,274 which was filed on Feb. 19, 2020, which claims priority to and the benefit of U.S. Provisional Patent Application Ser. No. 62/807,552 filed Feb. 19, 2019, entitled "Steam Generation Apparatuses, Processes, and Methods", the entirety of each of which is incorporated by reference herein.

TECHNICAL FIELD

The present disclosure relates to energy generation, and more particularly the generation of steam to generate energy.

BACKGROUND

Present day searches for energy are all encompassing, but primarily, present day searches for energy revolve around environmentally conscious energy sources. Energy sources can include combustion sources which are frowned upon in current day environmental policies for their contribution to carbon dioxide and carbon monoxide production, as well as other air and water pollutants. The present disclosure provides a steam energy generation apparatus, process and methods that can be used to prepare relatively clean energy.

SUMMARY

Steam production apparatuses are provided. The apparatuses can include: at least two compartments that are mechanically engaged; a first of the two compartments defining a chemical reaction compartment configured to house reactive material and receive liquid water; a second of the two compartments defining a biasing compartment housing memory metal operatively coupled to the mechanical engagement of the compartments; and fluid communication between the two compartments.

Processes for the production of steam are also provided. The processes can include providing liquid water to a reactive material within a first compartment to generate steam within the first compartment; transferring at least some of the steam to a second compartment that is mechanically engaged with the first compartment; and exposing the steam from the first compartment to material within the second compartment that extends when exposed to the steam, the extending of the material reducing the volume of the first compartment.

DRAWINGS

Embodiments of the disclosure are described below with reference to the following accompanying drawings.

Figure 5:
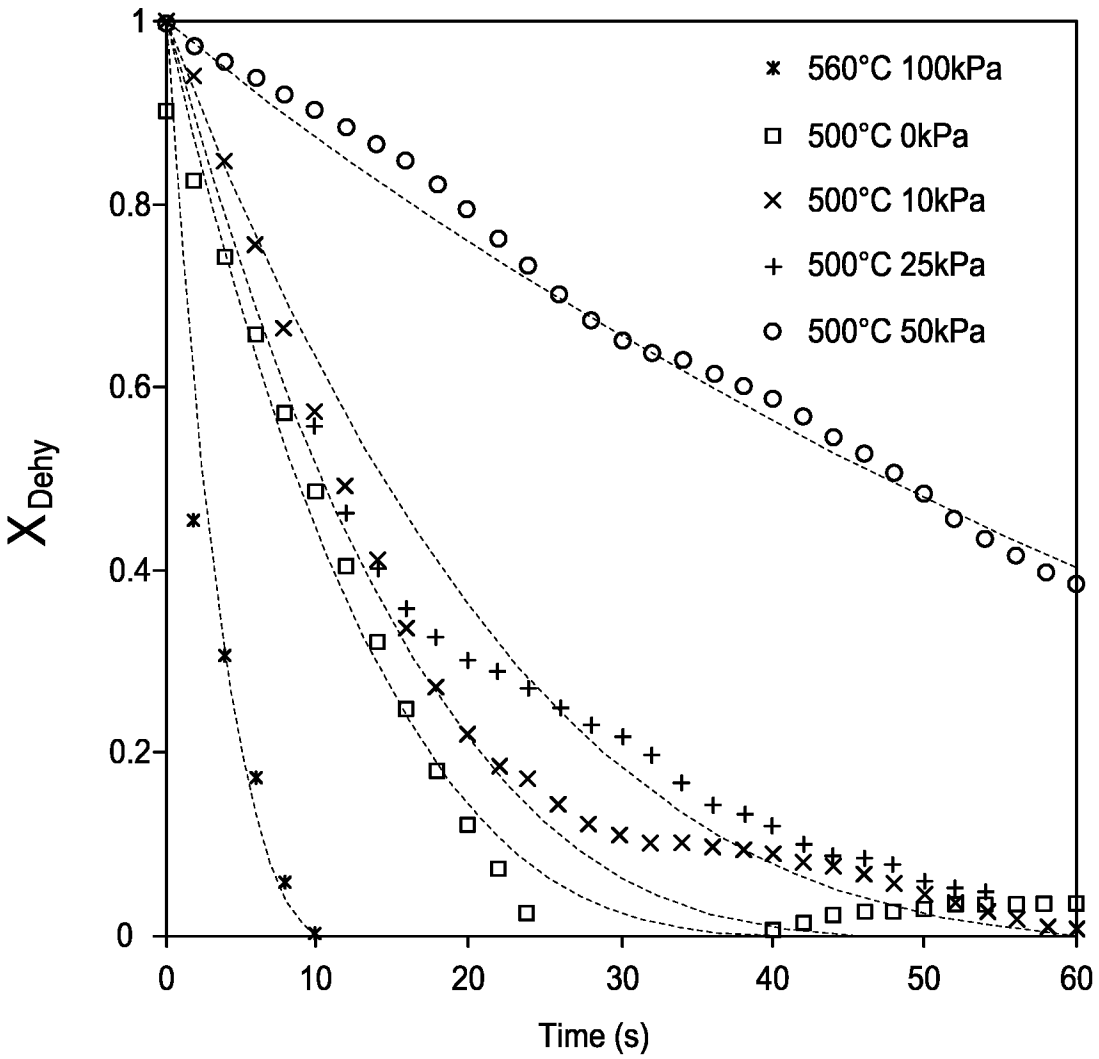

FIG. 5 graphically depicts pressure change with dehydration over time according to an embodiment of the disclosure.

FIGS. 6-10 depict a series of configurations of an apparatus that can be used in combination with processes according to an embodiment of the disclosure.

DESCRIPTION

This disclosure is submitted in furtherance of the constitutional purposes of the U.S. Patent Laws "to promote the progress of science and useful arts" (Article 1, Section 8).

Figure 1:
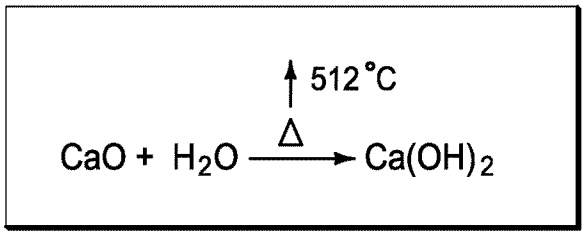
FIG. 1 is a depiction of a chemical scheme that can be leveraged according to an embodiment of the disclosure.
Figure 2:
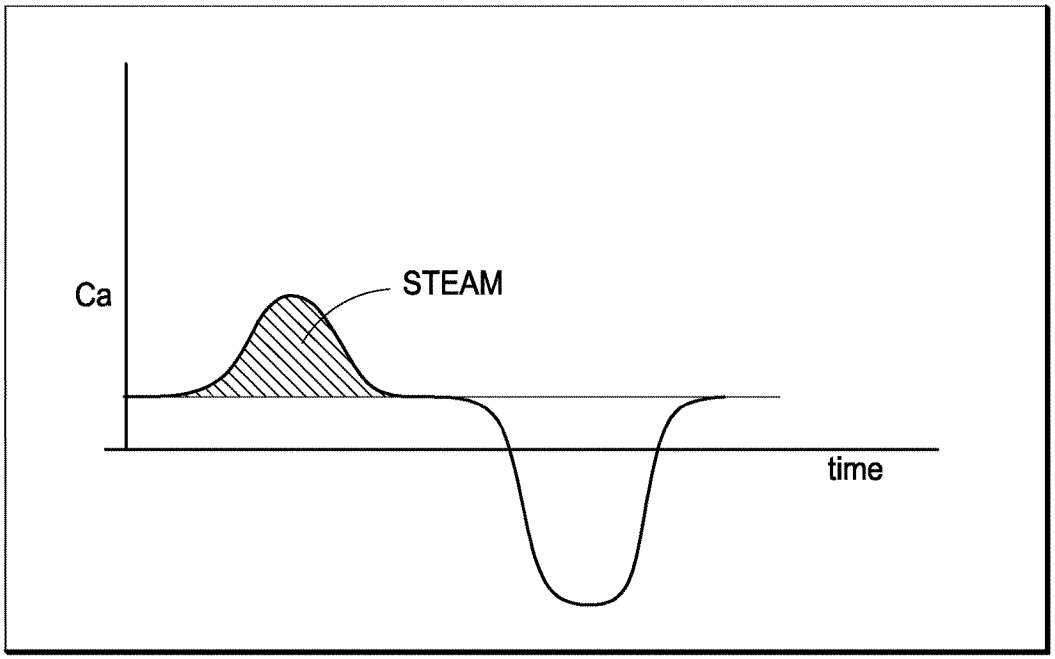
FIG. 2 is a graphical depiction of calcium and its production of steam over time and replaced for its production of solids over time.
Figure 3:
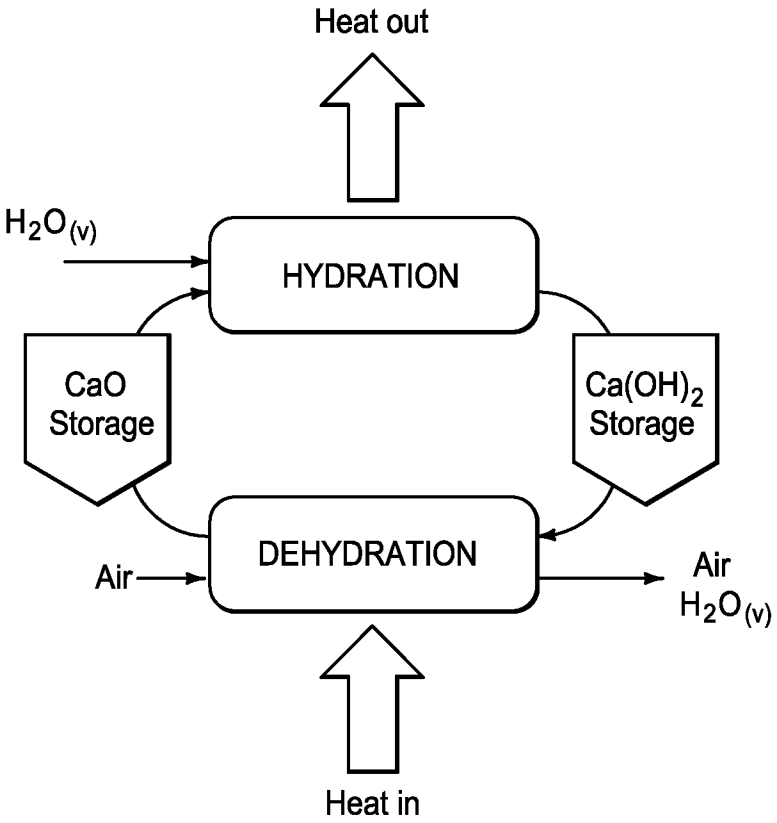
FIG. 3 is a hydration and dehydration cycle that can be utilized in combination with calcium oxide and hydroxide according to an embodiment of the disclosure.

The apparatus, processes, and methods of the present disclosure will be described with reference to FIGS. 1-10. Referring first to FIG. 1, a chemical schematic is shown of the hydration of calcium oxide and the release of approximately 512° C. of thermal release to form calcium hydroxide. This chemical equation can be utilized to generate an extreme amount of heat which can in turn be utilized to generate steam which can in turn be utilized to generate pressure. As shown in FIG. 2, the steam can be generated at one phase over time, and then reverted to be formed to solid, and then cycled back as shown in FIG. 3, where a volume of water can be introduced to calcium oxide storage to initiate hydration and heat can be generated in a chamber. As the hydration continues, the solids or calcium oxide is changed into the form of calcium hydroxide which can be used in storage and exposed to air to form dehydration, which requires a heat source. As a result of the dehydration air and water is provided. That water can be cycled back for hydration of calcium oxide that has been stored.

Figure 4:
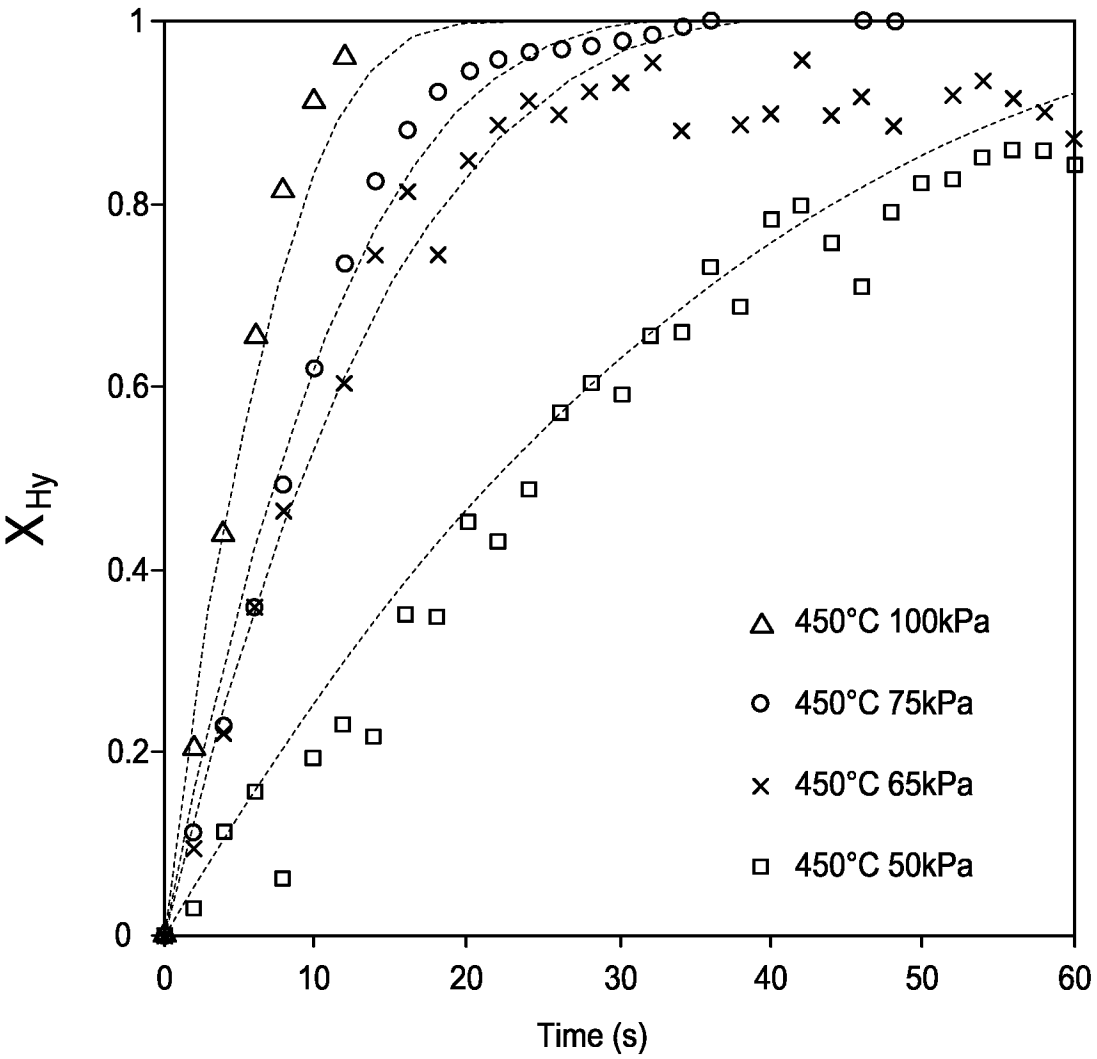
FIG. 4 depicts a pressure differentiation utilizing hydration over time according to an embodiment of the disclosure.

Referring next to FIG. 4, a hydration speciation is shown over different temperature ranges, generating different pressures. As can be seen, these pressures can increase. As the temperatures increase, so do the pressures. Again, referring next to FIG. 5, during dehydration, while temperatures are required to provide the dehydration of calcium hydroxide to calcium oxide, the pressures are reduced as well.

Figure 6:
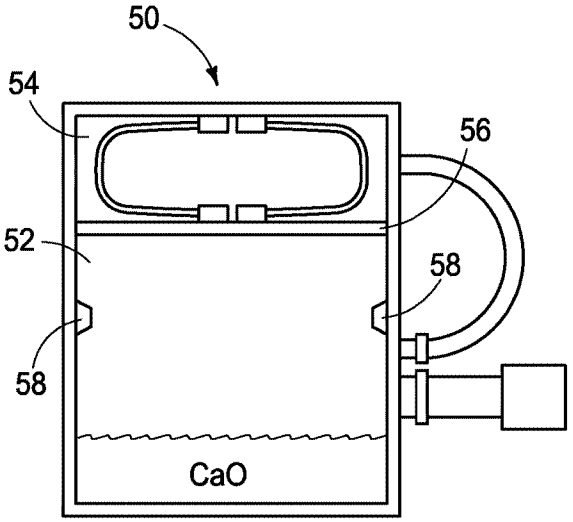
Figure 10:
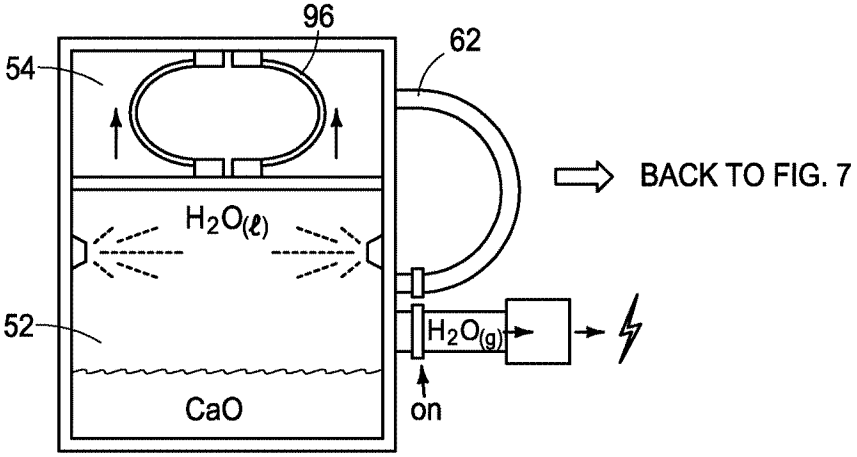

Referring next to FIG. 6, an apparatus 50 is shown that includes two compartments 52 and 54. Compartment 52 is configured to house a solid chemical species such as calcium oxide and at other times, calcium hydroxide. Compartment 54 is configured to house at least a biasing construct that includes example biasing means. Between compartments 52 and 54 can be a slidable member 56, which can transition between at least two positions within apparatus 50. Slidable member 56 can be engaged along the walls of compartment 52 or 54 to separate a non-fluid communication between compartments 54 and 52, but a physical communication in the form of the transition of steam and solids between calcium oxide and calcium hydroxide as transitioning in the apparatus. In accordance with an example configuration, and with reference to FIG. 7, an amount of calcium oxide is maintained within compartment 52 and exposed to liquid water via nozzles 58. Nozzles 58 can extend from the slidable member 56 or side walls of compartment 52 as desired. Accordingly, with the fluid communication conduit 62 engaged in the off position, steam will be generated, and the slidable member engaged in a position reducing the volume of compartment 54 and expanding the volume of compartment 52.

Figure 8:
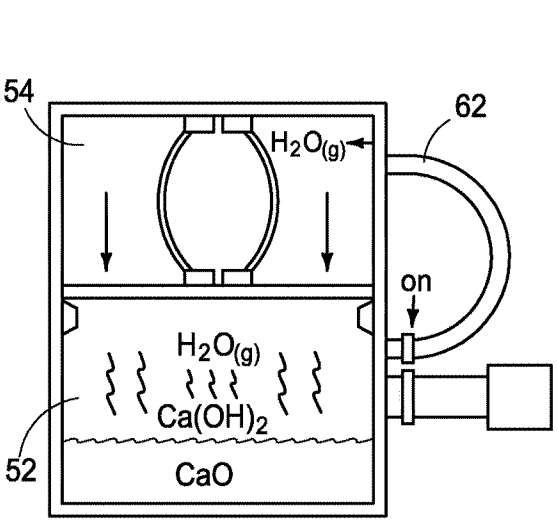
Figure 7:
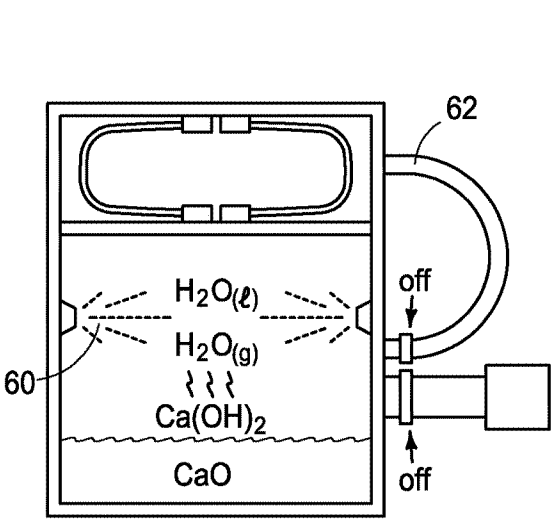

Referring next to FIG. 8, when conduit 62 is allowed to fluidly engage between compartments 54 and 52, the steam generated in compartment 52 transitions to compartment 54, thereby expanding the volume of compartment 54 and reducing the volume of compartment 52.

Figure 9:
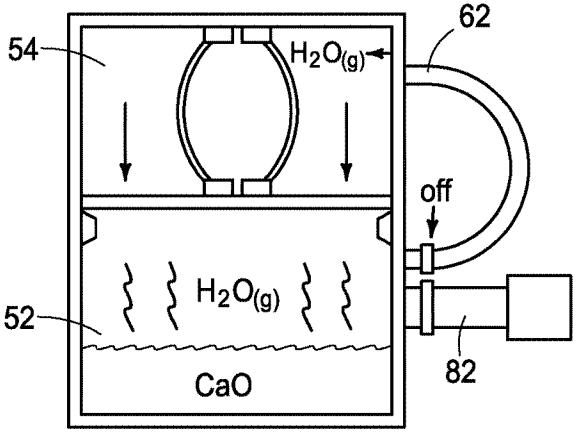

Referring next to FIG. 9, fluid communication 62 is turned to the off position, thereby disengaging fluid communication between compartment 54 and 52. However, while with reference to FIG. 10, water in the form of gas or steam is still generated within compartment 52. This water in the form of gas or steam can be provided to another apparatus not shown, but operably connected to a conduit 82. The apparatus utilizing the steam generated according to the apparatus and methods of the present disclosure can be an apparatus that utilizes the steam to form consumable energy. For example, a steam turbine can be utilized to generate electricity. Moreover, because the relative size of the present apparatus, the apparatus may be placed proximate electricity needs. For example, the home, office, or charging stations.

As shown in FIGS. 6-10, nitinol bands singularly or multiple bands 96 can be aligned to provide for the return of slidable member 56 to the upright position wherein compartment 54 has less volume than compartment 52. Accordingly, utilizing these nitinol bands with slidable member 56 can allow for apparatus 50 to transition between states of generating sufficient steam to operate a turbine and states of generating sufficient pressure to hydrate calcium oxide to calcium hydroxide or dehydrate calcium hydroxide to calcium oxide.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A process for the production of steam comprising:

providing liquid water to a reactive material within a first compartment to generate the steam within the first compartment;

transferring at least some of the steam to a second compartment that is mechanically engaged with the first compartment; and exposing the steam from the first compartment to a material within the second compartment that extends when exposed to the steam, the extending of the material reducing the volume of the first compartment.

2. The process of claim 1 further comprising providing the steam from the first compartment to a steam turbine.

3. The process of claim 1 further comprising providing additional liquid water to the reactive material within the first compartment to expand the volume of the first compartment and contract the material within the second compartment.

4. The process of claim 1 further comprising moving a shared sidewall of the first compartment and the second compartment to change the volumes within the first compartment and second compartment.

* * * * *